US010119382B2

(12) United States Patent
Arabskyy et al.

(10) Patent No.: US 10,119,382 B2
(45) Date of Patent: Nov. 6, 2018

(54) BURST PLUG ASSEMBLY WITH CHOKE INSERT, FRACTURING TOOL AND METHOD OF FRACTURING WITH SAME

(71) Applicant: Tartan Completion Systems Inc., Edmonton (CA)

(72) Inventors: Serhiy Arabskyy, Beaumont (CA); Dwayne Dubourdieu, Calgary (CA); Ryan David McGillivray, Edmonton (CA)

(73) Assignee: Tartan Completion Systems Inc., Edmonton (CA)

( * ) Notice: Subject to any disclaimer, the term of this patent is extended or adjusted under 35 U.S.C. 154(b) by 0 days.

(21) Appl. No.: 15/424,285

(22) Filed: Feb. 3, 2017

(65) Prior Publication Data

US 2017/0218741 A1 Aug. 3, 2017

Related U.S. Application Data

(60) Provisional application No. 62/290,817, filed on Feb. 3, 2016.

(51) Int. Cl.
*E21B 43/26* (2006.01)
*E21B 33/12* (2006.01)
(Continued)

(52) U.S. Cl.
CPC ..... *E21B 43/26* (2013.01); *E21B 17/1007* (2013.01); *E21B 33/124* (2013.01);
(Continued)

(58) Field of Classification Search
CPC ..... E21B 43/26; E21B 21/103; E21B 23/02; E21B 17/18; E21B 2034/007; E21B 21/10; E21B 23/01
See application file for complete search history.

(56) References Cited

U.S. PATENT DOCUMENTS 2,191,750 A 2/1940 Brown
2,630,939 A 3/1953 Jones
(Continued)

FOREIGN PATENT DOCUMENTS

CA 2441757 C 7/2010
CA 2760107 A1 11/2010
(Continued)

OTHER PUBLICATIONS

International Search Report with Written Opinion corresponding to International Patent Application No. PCT/CA2016/000030, dated Oct. 31, 2016.
(Continued)

*Primary Examiner* — Zakiya W Bates
(74) *Attorney, Agent, or Firm* — Leydig, Voit & Mayer, Ltd.

(57) ABSTRACT

A burst plug assembly for use in the fluid port of tubular fracturing tools to provide erosion resistance. The assembly has a body with an annular side wall and a closing wall closing the central bore of the annular side wall. A choke insert is retained in the central bore of the body to line the inner surface of the central bore. A groove in a face of the closing wall circumscribes a core in the bottom wall, and is sized and located so that a largest dimension of the core is no greater than a diameter of the inner bore of the choke insert, such that when a prescribed threshold hydraulic pressure level of the treatment fluid is applied to the closing wall the core disengages from the closing wall along the groove in a bursting action and passes through the inner bore of the choke insert.

22 Claims, 10 Drawing Sheets

(51) Int. Cl.

| | |
|---|---|
| ***E21B 17/10*** | (2006.01) |
| ***E21B 33/124*** | (2006.01) |
| ***E21B 34/06*** | (2006.01) |
| *E21B 34/00* | (2006.01) |

(52) U.S. Cl.
CPC ..... *E21B 33/1212* (2013.01); *E21B 34/06* (2013.01); *E21B 2034/007* (2013.01)

(56) References Cited

U.S. PATENT DOCUMENTS

| | | | |
|---|---|---|---|
| 3,908,684 | A | 9/1975 | Short |
| 4,867,241 | A | 9/1989 | Stubhar |
| 6,095,247 | A | 8/2000 | Streich et al. |
| 6,131,662 | A | 10/2000 | Ross |
| 7,096,954 | B2 | 8/2006 | Weng et al. |
| 7,581,596 | B2 | 9/2009 | Reimert et al. |
| 7,640,988 | B2 | 1/2010 | Phi et al. |
| 7,673,673 | B2 | 3/2010 | Surgaatmadja et al. |
| 8,167,047 | B2 | 5/2012 | Themig et al. |
| 8,215,411 | B2 | 7/2012 | Flores et al. |
| 8,245,788 | B2 | 8/2012 | Garcia et al. |
| 8,267,178 | B1 | 9/2012 | Sommers et al. |
| 8,424,610 | B2 | 4/2013 | Newton et al. |
| 8,479,822 | B2 | 7/2013 | Hofman et al. |
| 8,613,321 | B2 | 12/2013 | Ravensbergen et al. |
| 8,672,030 | B2 | 3/2014 | Sherman |
| 8,695,716 | B2 | 4/2014 | Ravensbergen et al. |
| 8,776,884 | B2 | 7/2014 | Xu et al. |
| 8,783,365 | B2 | 7/2014 | McCoy et al. |
| 8,794,331 | B2 | 8/2014 | Getzlaf et al. |
| 8,869,898 | B2 | 10/2014 | Xu et al. |
| 8,910,717 | B2 | 12/2014 | Mailand et al. |
| 9,004,180 | B2 | 4/2015 | Jackson |
| 9,228,421 | B2 | 1/2016 | Kent et al. |
| 9,297,241 | B2 | 3/2016 | Arabskyy |
| 9,404,343 | B2 | 8/2016 | Themig et al. |
| 2002/0136904 | A1 | 9/2002 | Glass et al. |
| 2010/0282330 | A1 | 11/2010 | Luther et al. |
| 2011/0067871 | A1 | 3/2011 | Burdette et al. |
| 2011/0155377 | A1 | 7/2011 | Laun |
| 2011/0192613 | A1 | 8/2011 | Garcia et al. |
| 2014/0034310 | A1* | 2/2014 | Andersen ..... E21B 34/14 166/281 |
| 2014/0102709 | A1 | 4/2014 | Arabskyy |
| 2014/0151052 | A1 | 6/2014 | Themig et al. |
| 2014/0231064 | A1 | 8/2014 | Kent et al. |
| 2015/0152709 | A1 | 6/2015 | Tough et al. |
| 2015/0260012 | A1 | 9/2015 | Themig |

FOREIGN PATENT DOCUMENTS

| | | | |
|---|---|---|---|
| CA | 2670218 | A1 | 12/2010 |
| CA | 2412072 | C | 6/2012 |
| CA | 2692377 | C | 6/2012 |
| CA | 2824767 | A1 | 8/2012 |
| CA | 2772277 | A1 | 10/2012 |
| CA | 2683432 | C | 5/2013 |
| CA | 2716834 | C | 7/2013 |
| CA | 2797457 | A1 | 7/2013 |
| CA | 2867207 | A1 | 12/2014 |
| CA | 2755848 | C | 8/2016 |
| WO | 2012/065259 | A1 | 5/2012 |
| WO | 2013/016822 | A1 | 2/2013 |
| WO | 2014/053062 | A1 | 4/2014 |
| WO | 2015/095950 | A1 | 7/2015 |
| WO | 2015/117221 | A1 | 8/2015 |
| WO | 2015/117224 | A1 | 8/2015 |
| WO | 2015/176158 | A1 | 11/2015 |
| WO | 2016/074078 | A1 | 5/2016 |

OTHER PUBLICATIONS

International Preliminary Report on Patentability, dated Aug. 16, 2018, corresponding to International Application No. PCT/CA2016/000030 (filed Feb. 4, 2016), parent of the present application, 10 pp.

* cited by examiner

BURST PLUG ASSEMBLY WITH CHOKE INSERT, FRACTURING TOOL AND METHOD OF FRACTURING WITH SAME

CROSS REFERENCE TO RELATED APPLICATIONS

This application claims priority from U.S. Provisional Patent Application No. 62/290,817 filed Feb. 3, 2016, which is incorporated by reference herein to the extent that there is no inconsistency with the present disclosure.

FIELD OF THE INVENTION

The present invention relates to methods and fracturing tools for hydraulic fracturing of a wellbore, and more particularly to a burst plug assembly with a choke insert and to fracturing tools and methods of fracturing using same.

BACKGROUND

Hydraulic fracturing is a stimulation treatment which consists of propagating fractures in rock layers by the introduction of a pressurized treatment fluid. The treatment fluid is pumped at high pressure into the hydrocarbon bearing area of a wellbore that extends into the target reservoir. The high pressure fluid when hydraulically injected into the wellbore causes cracks or fractures which extend outwardly and away from the wellbore into the surrounding rock formation.

Depending on the nature of the reservoir and the particular rock formation, acid, chemicals, sand or other proppants are selectively mixed into the treatment fluid to improve or enhance the recovery of hydrocarbons within the formation.

There have been a number of recent developments with respect to wellbore treatment tools including the development of tubular fracturing strings for staged well treatment. Such fracturing strings are predicated on creating a series of isolated zones within a wellbore using packers. Within each zone there are one or more fluid ports that can be selectively opened from the surface by the operator. A common mechanism includes a sliding sub actuated by a ball and seat system, the movement of which is used to open fluid ports. By sizing the seats and balls in a complimentary manner, increasingly larger balls may be used to selectively activate a particular sliding sub allowing the operator to stimulate specific target areas.

Further development and refinement has resulted in fracturing strings having multiple fluid ports within each isolated zone. The seats and balls are sized such that one ball may be used to actuate a series of sliding subs within an isolated zone or a series of sliding subs in different isolated zones. This is achieved using seats that expand or deform to allow the ball to pass. The ball is deployed from the surface, travels down the well bore, and becomes lodged on the deformable seat to form a temporary seal. The fluid pressure on the ball and seat actuates the sliding sub from its initial, first position into its second position, and in the process opens the fluid port. With continued fluid pressure, the seat eventually deforms, allowing the ball to pass through the seat and down to the next sliding sub, where it actuates the next sliding sub in the same manner. The last or lowest seat in the isolated zone is sized such that the ball will not pass, thus forming a seal to prevent the flow of treatment fluid to any lower zones that may have already been actuated and treated. The use of multiple fluid ports allows multiple stages within the isolated zone to be stimulated with one surface treatment. This type of fracturing method is generally termed limited entry fracturing.

When using a fracturing string with multiple deformable seats and a single ball, as described above, the operator may encounter difficulties in fracturing the lower regions of the formation within the isolated zone. The reason for this problem is that the seats are designed so that greater fluid pressure is needed to push the ball past the lower situated seats than the higher situated seats. This greater fluid pressure may be sufficient to force the fluid from the fracturing string into the well bore and to fracture the formation surrounding the already opened higher fluid ports. This results in a loss of fluid which is counterproductive to increasing fluid pressure in the fracturing string. Accordingly, the operator may be unable to achieve sufficient fluid pressure to push the ball past the seats and actuate the sliding subs situated in the lower regions of the formation. Even if the operator can achieve sufficient pressure to activate the subs in the lower regions of the formation, the pressure may still be sub-optimal for stimulating the lower regions of the formation. Prior art solutions have enjoyed limited success and are relatively complicated.

More recent developments in fracturing have suggested the use of rupture disks or burst disks within the fracturing tools. For example, U.S. Patent Publication No. 2011/0192613 to Garcia et al., and U.S. Patent Publication No. 2015/0260012 to Themig describe fracturing tools having fluid ports covered with temporary port covers which are designed to gradually tear or erode to an open position with the use of erosive and/or corrosive treatment fluids. This can cause problems with the fracturing operation, since initial pumping rates to gradually erode or corrode the fluid covers are low and less predictable until the fluid cover is fully eroded to open the fluid ports. Low flow rates of fracturing fluids are generally not desirable since the treatment fluid is carrying sand, and "sanding off" or plugging of the fluid ports and other equipment can occur at low flow rates. As well, there is less precision in directing the treatment fluid to the desired area to be fractured while the treatment fluid is being pumped at low flow rates.

Applicant's earlier patent application, U.S. Patent Publication No. 2014/0102709 to Arabskyy, describes a fracturing tool and method in which the fluid ports of a fracturing tool are closed by a burst plug which is designed to allow treatment fluid to flow through the fluid port in response to a prescribed threshold hydraulic pressure level of the treatment fluid. Particularly for limited entry fracturing processes, this fracturing tool and method allows for greater reliability and precision for operators, since the opening pressure of the fluid ports is a prescribed threshold pressure that can be set considerably higher than the pressure needed to shift the sliding subs in a series of fracturing tools. Thus, the operator can be confident that the fluid ports are not opened below the prescribed threshold pressure of the burst plugs, thus preventing the escape of treatment fluids from the fluid ports within an isolated zone until the treatment fluid pressure has been raised to the level required for hydraulic fracturing.

More recent patents and patent applications describing fracturing tools with burst plugs include PCT Patent Publications WO 2015/095950, WO 2015/117221 and WO 2015/117224, all to Arabsky et al., and U.S. Pat. No. 9,228,421 to Kent et al.

In fracturing operations, reliable opening of the flow ports in the fracturing tools is important. Operators prefer reliable and predictable flow restrictions (i.e., flow area and diameter) at the flow ports when pumping fluid downhole.

Erosion of the fluid ports, whether or not closed with burst plugs, remains problematic in fracturing operations, particularly in view of the erosive and/or corrosive nature of the treatment fluids.

SUMMARY OF THE INVENTION

A burst plug assembly is provided for use in a fluid port formed in a side wall of a tubular fracturing tool, the fluid port extending from an inner surface of a central bore of the fracturing tool to an outer surface of the fracturing tool. The burst plug assembly includes a body having an annular side wall and a closing wall. The side wall has an inner surface and an outer surface, the outer surface being adapted to retain and seal the body in the fluid port of the fracturing tool, and the inner surface forming an outwardly opened central bore which is closed by the closing wall. The closing wall has opposed inner and outer faces, with the outer face facing the central bore of the body. A choke insert is retained in the central bore of the body and lines the inner surface of the annular side wall along the central bore. The choke insert forms an inner bore which extends through the choke insert. The choke insert is formed of a wear resistant material. A groove formed in one or both of the inner and outer faces of the closing wall circumscribes a core in the closing wall. The groove is sized and located so that a largest dimension of the core is no greater than a diameter of the inner bore, such that when a prescribed threshold hydraulic pressure level of a treatment fluid is applied to the closing wall, the core disengages from the closing wall along the groove in a bursting action and passes through the inner bore of the choke insert, so that the treatment fluid can be pumped under pressure through the inner bore with limited erosion of the inner bore of the choke insert.

In some embodiments of the burst plug assembly, the core is circular and the diameter of the groove and the diameter of the inner bore are sized such that the inner bore is fully open after the core disengages, so that continued pumping of the treatment fluid through the inner bore maintains a prescribed flow rate of the treatment fluid sufficient for fracturing a wellbore adjacent the burst plug assembly without significant variation due to erosion of the inner bore of the choke insert.

In some embodiments of the burst plug assembly, the closing wall is a bottom wall formed integrally with the annular side wall at an inward end portion of the side wall. In some embodiments, the inner surface of the annular side wall and an outer surface of the choke insert are formed with engaging threads to retain the choke insert in the central bore and to provide a metal to metal seal between the body and the choke insert. In some embodiments, the groove is formed in the inner face of the bottom wall, and a portion of the bottom wall extending between the annular side wall and the groove forms a seat for the choke insert, so that after the circular core disengages, the groove forms a lip to direct the treatment fluid into the inner bore while preventing the treatment fluid from penetrating the engaging threads between the choke insert and the body. In some embodiments, the choke insert extends along the entire inner surface of the annular side wall.

Also broadly provided is a fracturing tool for use in a fracturing string for hydraulically fracturing a wellbore with treatment fluid using a prescribed threshold hydraulic pressure level. The fracturing tool includes a tubular housing extending longitudinally between opposing first and second ends arranged for connection in series with the fracturing string. The tubular housing has an inner surface defining a central bore extending through the tubular housing from the first end to the second end, and a fluid port extending from the inner surface to an outer surface of the tubular housing for fluid communication between the central bore and the wellbore. A burst plug assembly as set out above is retained and sealed in the fluid port. The burst plug assembly is operable from a closed condition, in which the burst plug assembly maintains a fluid seal to prevent the treatment fluid flowing through the fluid port below the prescribed threshold hydraulic pressure level, to an open condition, in which the core passes through the inner bore and the burst plug assembly is opened in response to the prescribed threshold hydraulic pressure level of the treatment fluid to allow the treatment fluid to flow through the inner bore of the burst plug assembly. A closure member is supported within the central bore of the tubular housing and is operable between a first position in which the burst plug assembly is covered by the closure member and a second position in which the burst plug assembly is substantially unobstructed by the closure member.

In some embodiments, the fracturing tool includes a plurality of fluid ports circumferentially spaced about the tubular housing and oriented substantially perpendicularly to a longitudinal axis of the tubular housing, and the burst plug assembly is retained and sealed in each of the plurality of fluid ports.

In some embodiments, the closure member is a sliding sleeve having a seat formed therein and operable to shift from the first position to the second position when the actuating member is seated and sealed on the seat.

In some embodiments, particularly for limited entry, multi-fracturing operations, the fracturing tool includes a closure member which includes a sleeve member supported within the central bore of the tubular housing so as to be longitudinally slidable relative to the tubular housing between the first position in which the burst plug assembly is covered by the sleeve member and the second position in which the burst plug assembly is substantially unobstructed by the sleeve member. The sleeve member includes a central passageway extending longitudinally therethrough, and a deformable seat disposed in the central passageway. The deformable seat is operable between a first condition in which the deformable seat is adapted to receive the actuating member seated thereon and a second condition in which the deformable seat is adapted to allow the actuating member to pass through the central passageway. The deformable seat is operable from the first condition to the second condition only upon displacement of the sleeve member into the second position. Seals are operatively supported between the sleeve member and the tubular housing to prevent leaking of the treatment fluid from the tubular housing to the at least one fluid port in the first position of the sleeve member.

Also broadly provided is a method of hydraulically fracturing an isolated zone in a wellbore using a treatment fluid which can achieve a prescribed threshold hydraulic pressure level. The isolated zone may be isolated with a cement liner or with a plurality of packers. The method includes the following steps:

i) providing a fracturing tool in a fracturing string spanning the isolated zone of the wellbore, the fracturing tool comprising:

- a tubular housing having an inner surface defining a central bore and a fluid port extending through a side wall of the tubular housing,
- a burst plug assembly retained and sealed in the fluid port, the burst plug assembly being operable from a closed condition, in which the burst plug assembly maintains a fluid seal to prevent the treatment fluid flowing through the fluid port below the prescribed threshold hydraulic pressure level, to an open condition, in which the burst plug assembly is opened in response to the prescribed threshold hydraulic pressure level of the treatment fluid, the burst plug assembly having a choke insert formed with an inner bore such that, in the open condition the treatment fluid flows through the inner bore, the choke insert being formed of a wear resistant material; and a closure member supported within the central bore of the tubular housing operable between a first position in which the burst plug assembly is covered by the closure member and a second position in which the burst plug assembly is substantially unobstructed by the closure member;

ii) locating the fracturing tool in a fracturing string spanning the isolated zone of the wellbore with the closure member in the first position;

iii) moving the closure member to the second position;

iv) pumping the treatment fluid to achieve the prescribed threshold hydraulic pressure level to open the burst plug assembly in the fluid port; and v) continuing pumping the treatment fluid under pressure through the inner bore of the burst plug assembly at a prescribed flow rate sufficient for hydraulically fracturing the isolated zone adjacent the burst plug assembly without significant variation due to erosion of the inner bore of the burst plug assembly.

In some embodiments, of the method, the closure member comprises a sleeve member sealed within the central bore of the tubular housing so as to be longitudinally slidable relative to the tubular housing, in response to an actuating member being seated within the sleeve member, between the first position in which the burst plug assembly is covered by the sleeve member and the second position in which the burst plug assembly is substantially unobstructed by the sleeve member. The sleeve member is moved to the second position by directing the actuating member through the tubing string to seat in the sleeve member to displace the sleeve member into the second position, and to seal against the flow of the treatment fluid past the sleeve member at an actuation hydraulic pressure level of the treatment fluid which is less than the prescribed threshold hydraulic pressure level of the treatment fluid.

In some embodiments of the method, the fluid port is one of a plurality of fluid ports circumferentially spaced about the tubular housing and oriented substantially perpendicularly to a longitudinal axis of the tubular housing, with the burst plug assembly as set forth above retained and sealed in each of the plurality of fluid ports. In such embodiments, continued pumping of the treatment fluid under pressure is continued through the inner bore of each burst plug assembly at the prescribed flow rate without significant variation due to erosion of the inner bore of any one of the burst plug assemblies.

In some embodiments, the method is adapted for hydraulically fracturing multiple stages within a lower isolated zone in the wellbore with the treatment fluid which can achieve a prescribed threshold hydraulic pressure level. The method includes the following steps:

a) providing a plurality of the fracturing tools, each of the plurality of the fracturing tools being connected in series with one another in a fracturing string spanning the lower isolated zone such that each of the plurality of the fracturing tools is associated with a respective stage of the lower isolated zone, wherein the closure member of each of the plurality of fracturing tools comprises:

a sleeve member supported within the central bore of the tubular housing so as to be longitudinally slidable relative to the tubular housing between the first position in which the burst plug assembly is covered by the sleeve member and the second position in which the burst plug assembly is substantially unobstructed by the sleeve member, the sleeve member comprising:

a central passageway extending longitudinally therethrough; and a deformable seat disposed in the central passageway so as to be operable between a first condition in which the deformable seat is adapted to receive the actuating member seated thereon and a second condition in which the deformable seat is adapted to allow the actuating member to pass through the central passageway, the deformable seat being operable from the first condition to the second condition only upon displacement of the sleeve member into the second position; and seals operatively supported between the sleeve member and the tubular housing to prevent leaking of the treatment fluid from the tubular housing to the at least one fluid port in the first position of the sleeve member;

b) providing a lowermost of the fracturing tools in the fracturing string below the plurality of the fracturing tools, the closure member of the lowermost fracturing tool comprising a sliding sleeve having a seat formed therein and operable to shift from the first position to the second position when the actuating member is seated and sealed on the seat;

c) providing one of the actuating members to be associated with the plurality of fracturing tools and the lowermost fracturing tool associated with the lower isolated zone;

d) directing the actuating member associated with the lower zone downwardly through the fracturing string to sequentially displace the sleeve member of each of the plurality of the fracturing tools associated with the lower isolated zone into the second position at an actuation hydraulic pressure level of treatment fluid which is less than the prescribed threshold hydraulic pressure level of treatment fluid;

e) locating and seating the actuating member within the lowermost fracturing tool associated with the lower isolated zone so as to shift the sliding sleeve to the second position and to form a seal against a flow of the treatment fluid;

f) pumping the treatment fluid to achieve the prescribed threshold hydraulic pressure level to open the burst plug assembly in the fluid port of the plurality of the fracturing tools and the lowermost fracturing tool associated with the lower isolated zone; and g) continuing pumping the treatment fluid under pressure through the inner bore of each burst plug assembly of the plurality of the fracturing tools and of the lowermost fracturing tool associated with the lower isolated zone at a prescribed flow rate sufficient for hydraulically fracturing the lower isolated zone adjacent each of the burst plug assemblies without significant variation due to erosion of the inner bore of any one of the burst plug assemblies.

In some embodiments of the method of fracturing multiple stages, the fluid port is one of a plurality of fluid ports circumferentially spaced about the tubular housing of each of the plurality of fracturing tools and the lowermost tool, and oriented substantially perpendicularly to a longitudinal axis of the tubular housing, with a burst plug assembly as set forth above retained and sealed in each of the plurality of fluid ports.

In some embodiments of the method of fracturing multiple stages, the method further includes hydraulically fracturing multiple stages within an upper isolated zone above the lower isolated zone by the steps of:

h) providing the plurality of the fracturing tools as set forth above, each of the plurality of the fracturing tools being connected in series with one another in a fracturing string spanning the upper isolated zone such that each of the plurality of fracturing tools is associated with a respective stage of the upper isolated zone;

i) providing the lowermost fracturing tool as set forth above in the fracturing string below the plurality of the fracturing tools of step h);

j) providing one of the actuating members to be associated with the plurality of the fracturing tools and the lowermost fracturing tool associated with the upper isolated zone;

k) repeating steps d) to g), but adapted to hydraulically fracture the wellbore within the upper isolated zone.

DETAILED DESCRIPTION

Figure 1:
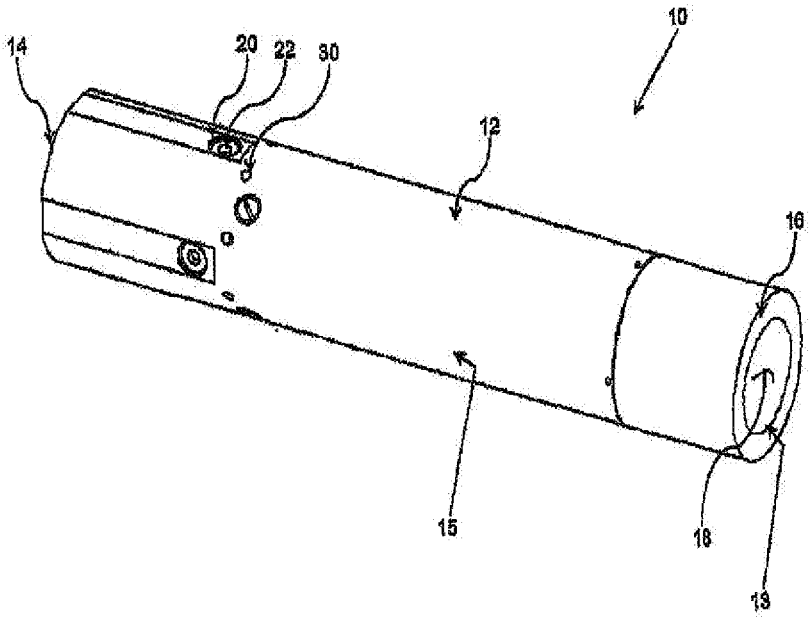
FIG. 1 is a perspective view of a first embodiment of a fracturing tool according to the present invention, with the details of one embodiment of a burst plug assembly being shown in greater detail in FIGS. 11-13.

The invention relates to a burst plug assembly 22, a fracturing tool 10, and methods for hydraulic fracturing within an isolated zone in a wellbore. As generally shown in the Figures, the fracturing tool 10 includes:

i) a tubular housing 12 which may be connected in series with a fracturing string with one or more fluid ports 20 communicating between a central bore 18 of the housing 12 and the wellbore, ii) a burst plug assembly 22 disposed in each fluid port 20, iii) a closure member such as a sleeve member 24 operable within the housing between a first position covering the fluid ports 20 and a second position in which the burst plug assemblies 22 are exposed.

For multi-frac methods, the closure member is typically a sleeve member 24 which include a deformable seat 26 defined by dogs 34 disposed within a central passageway 32 in the sleeve member 24. However, other closure members actuable mechanically or by pressure between a position covering the ports and a position in which the ports are uncovered, may be included, as are well known for fracturing operations.

The deformable seat 26 is operable from a first condition arranged to receive an actuating member 36 seated thereon to a second condition in which the actuating member 36 is arranged to pass through the tool 10 only once the sleeve member 24 has been displaced from the first position to the second position. Once the sleeve member 24 is in the second position and the deformable seat 26 is displaced into the second condition, the actuating member 36 is free to pass through the tool 10 to the next tool in the fracturing string in a series of tools associated with an isolated zone.

The actuating member 36 may be directed downwardly through the fracturing string, or tubing string, to be seated on the deformable seats 26 of respective tools 10 by various methods including mechanical actuation and pressure actuation. In the instance of mechanical actuation, the actuating member 36 can be supported at the bottom end of a tubing string so as to be displaced downwardly through the fracturing string to actuate respective fracturing tools 10 by injecting the tubing string into the fracturing string. When multiple different diameter actuating members 36 are provided for being associated with different isolated zones respectively, the tubing string used to convey the actuating member 36 has an outer diameter which is less than a smallest diameter actuating member 36 being used. In addition to different methods of actuation, the configuration of the actuating member 36 itself may take various different forms as described below.

Figure 3:
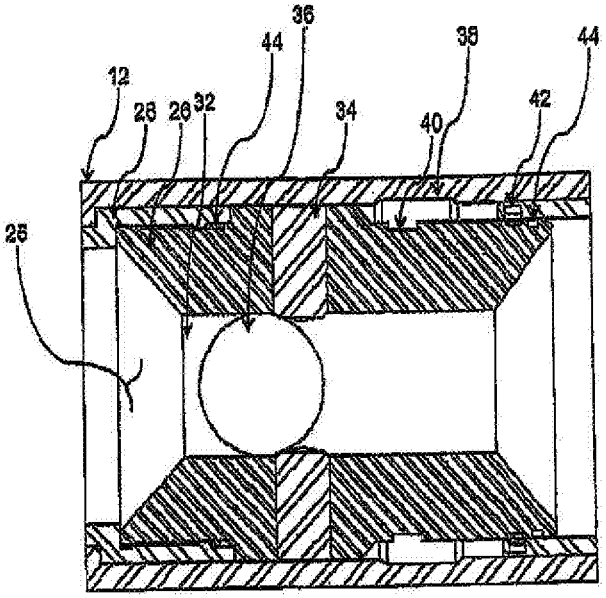
FIG. 3 is a longitudinal cross sectional view of the seat and ball of the fracturing tool of FIG. 1 in a first position of the sleeve with the deformable seat in a first condition.
Figure 4:
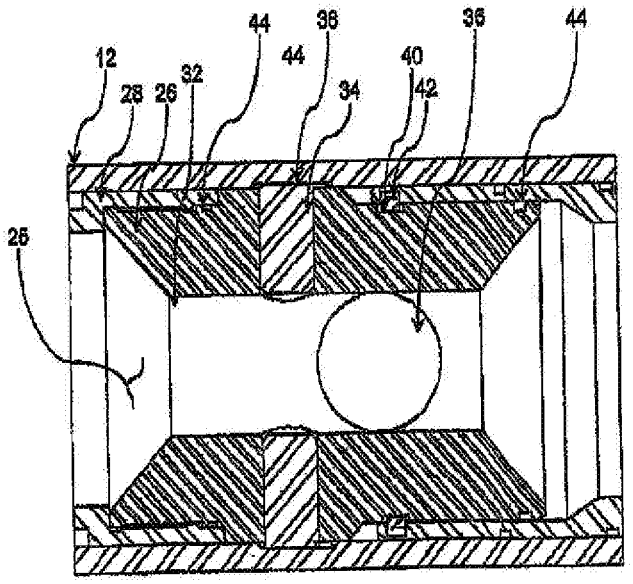
FIG. 4 is a longitudinal cross sectional view of the seat and ball of the fracturing tool of FIG. 1 in a second position of the sleeve with the deformable seat in a second condition.
Figure 5:
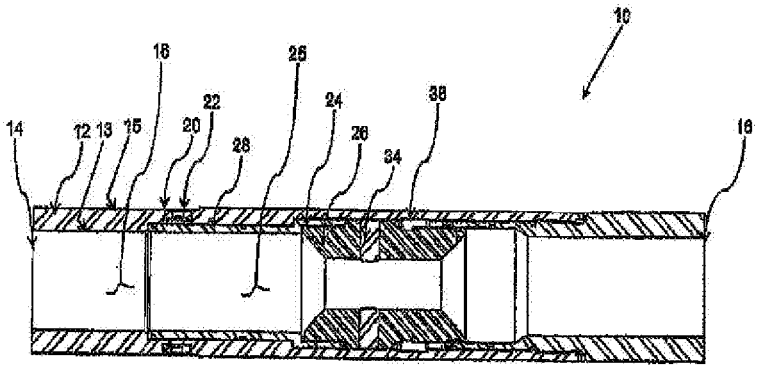
FIG. 5 is a longitudinal cross sectional view of the sleeve member of the tool of FIG. 1 in a first position of the sleeve with the deformable seat in a first condition.
Figure 6:
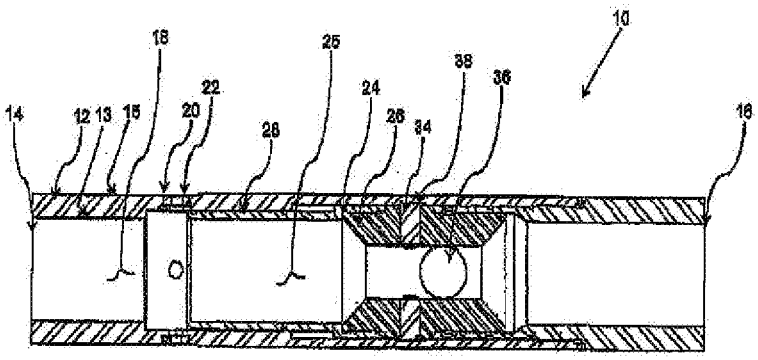
FIG. 6 is a longitudinal cross sectional view of the sleeve member of the fracturing tool of FIG. 1 in the second position of the sleeve with the deformable seat in the second condition.
Figure 7:
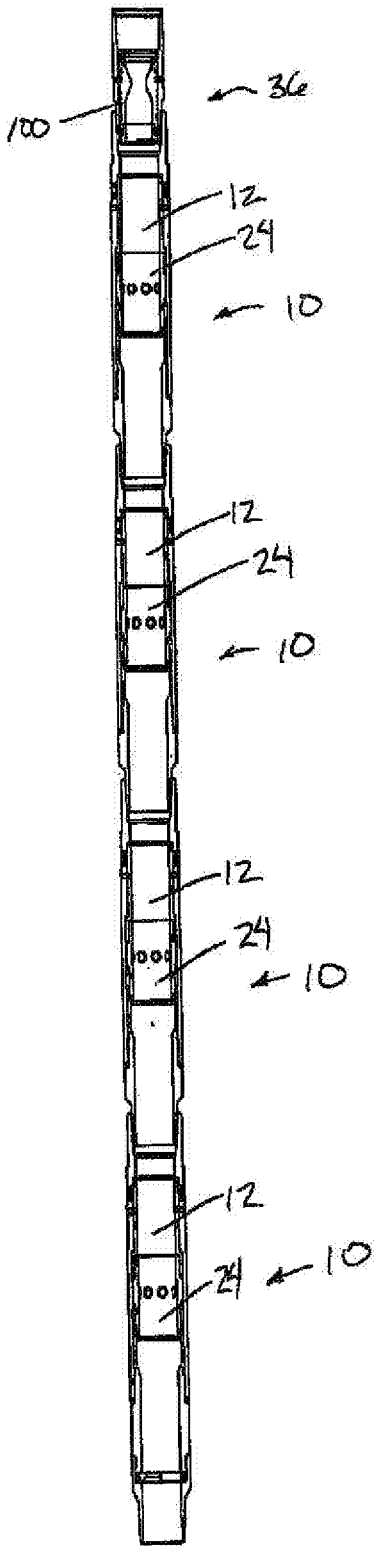
FIG. 7 is a longitudinal cross sectional view of a fracturing string including a plurality of fracturing tools according to a second embodiment of the present invention, with details of the burst plug assembly being shown in greater detail in FIGS. 11-13.
Figure 8:
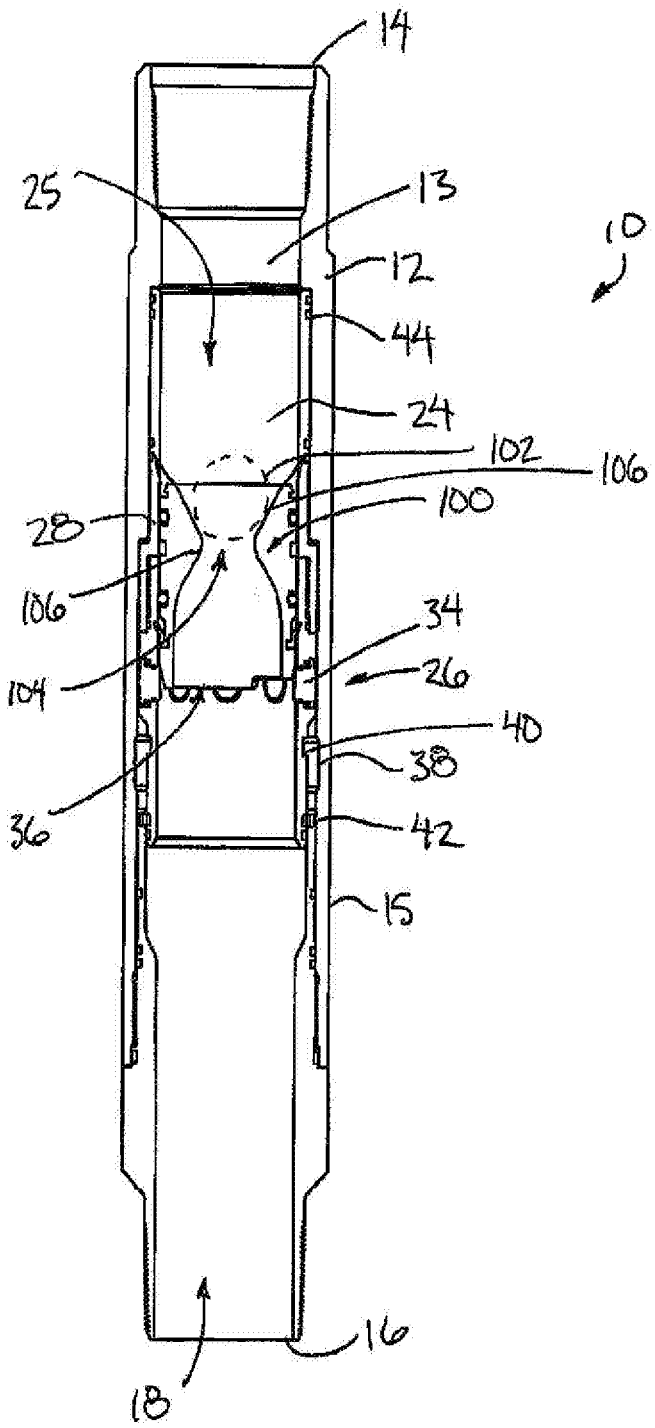
FIG. 8 is a longitudinal cross sectional view of the one of the fracturing tools of FIG. 7 in the first position of the sleeve with the deformable seat in the first condition.
Figure 9:
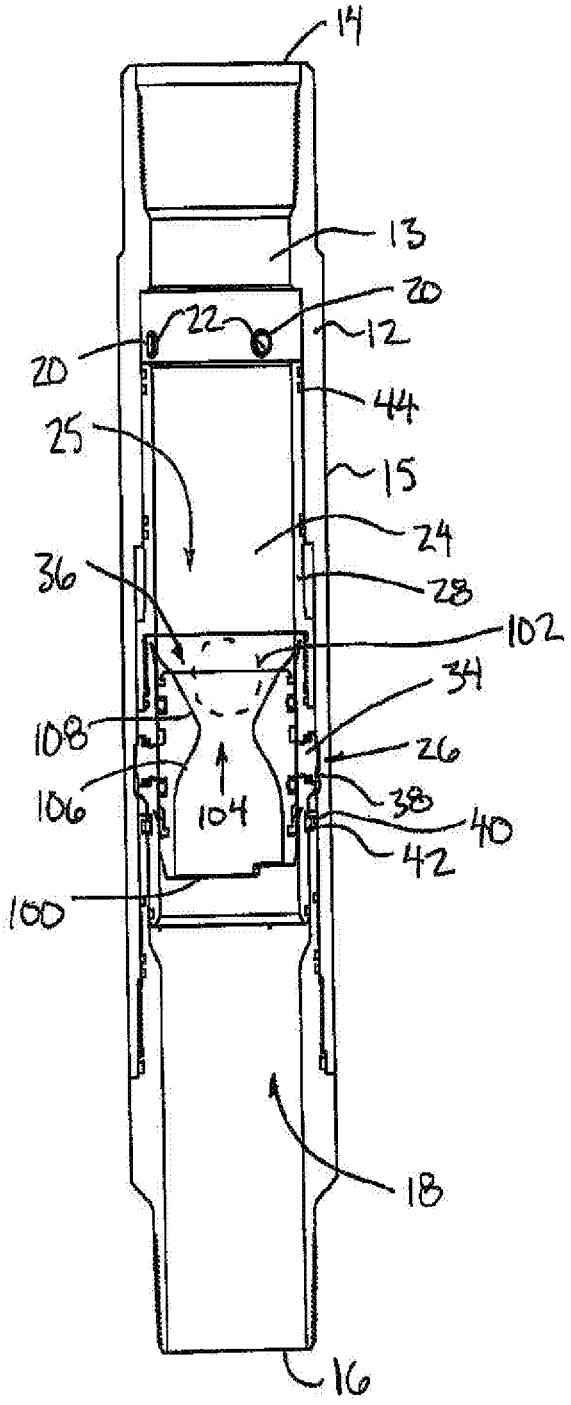
FIG. 9 is longitudinal cross sectional view of the fracturing tool of FIG. 8 in the second position of the sleeve with the deformable seat in the second condition.
Figure 10:
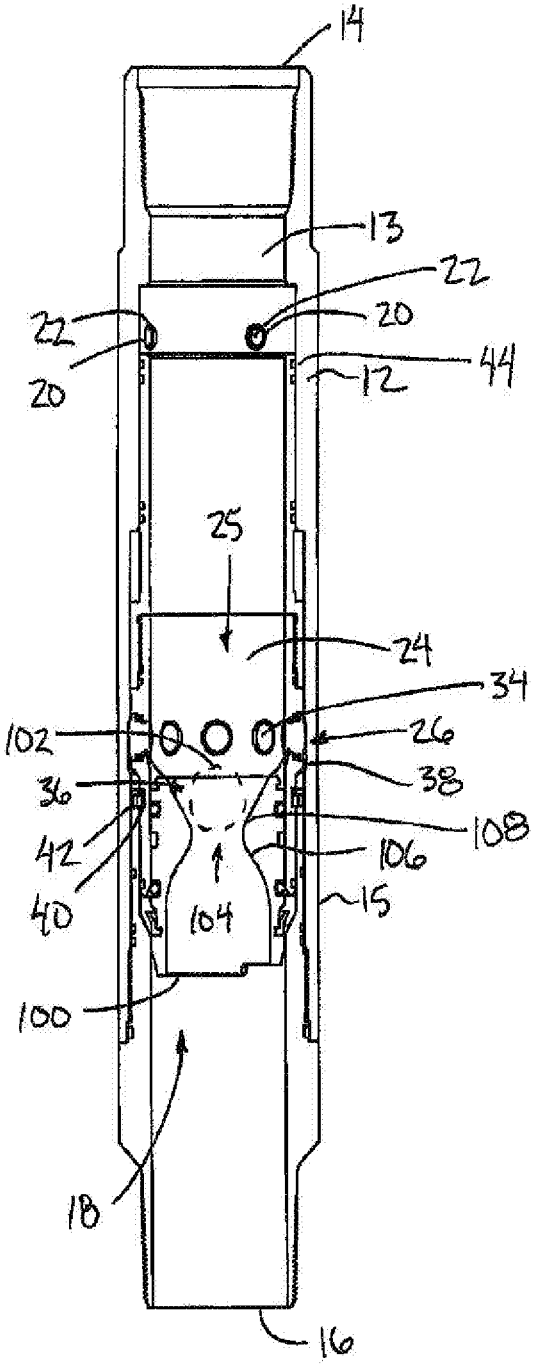
FIG. 10 is longitudinal cross sectional view of the fracturing tool of FIG. 8 in the second position of the sleeve with the deformable seat in the second condition in which the shuttle member is shown passing through the sleeve member for subsequently actuating another fracturing tool located therebelow.

An embodiment of a pressure actuated fracturing tool 10 is shown in FIGS. 1 to 6, in which FIG. 1 is an external perspective view of one embodiment of the tool 10 of the present invention, while FIGS. 5 and 6 show cross-sectional side views. The tool 10 includes the tubular housing 12 extending longitudinally between a first end 14 and an opposing second end 16 arranged for connection in series within the fracturing string. The tubular housing 12 has an inner surface 13 and an outer surface 15, the inner surface 13 defining a central bore 18 extending along the longitudinal axis of the tubular housing 12 from its first end 14 to its second end 16. Both the first end 14 and the second end 16 of the tubular housing 12 are configured to attach to a fracturing string such that the tool 10 may be installed into a fracturing string.

The tubular housing 12 has at least one fluid port 20 extending from the outer surface 15 to the inner surface 13 of the tubular housing 12 from the central bore 18 in an orientation that is substantially perpendicular to the longitudinal axis of the tubular housing 12. The fluid ports 20 allow fluid communication between the central bore 18 of the tubular housing 12 and the wellbore. In some embodiments a plurality of fluid ports 20 are positioned circumferentially around the tubular housing 12 as shown in FIG. 1. Each fluid port has a burst plug assembly 22 disposed therein. In some embodiments the burst plug assembly 22 is retained in the fluid port 20 by a threaded connection. In other embodiments the burst plug assembly is retained by a retaining ring, such as a snap ring.

The burst plug assemblies 22 are described in greater detail below. In general, each burst plug assembly is operable from a closed condition in which the burst plug assembly 22 prevents the treatment fluid flowing through the respective fluid port to an open condition in which the burst plug assembly 22 is arranged to allow treatment fluid flowing through the respective fluid port 20. The burst plug assemblies 22 are opened from the closed condition in response to the treatment fluid reaching a prescribed threshold hydraulic pressure level. In some embodiments, the burst plug assemblies include a body 200 formed from a material with consistent mechanical properties, for example a metal such as brass, bronze or aluminum, which is arranged to burst in response to the prescribed threshold hydraulic pressure level of the treatment fluid.

In the closed condition, the burst plug assembly 22 acts as a barrier preventing fluid communication between the central bore 18 and the wellbore. The burst plug assemblies 22 are configured to maintain their physical integrity, and thereby maintain a fluid seal, up to a certain threshold fluid pressure level. When the threshold fluid pressure is reached within the central bore 18 of the tubular housing 12, the burst plug assemblies 22 open, in a bursting action, and the flow of fluid from the central bore 18 to the wellbore through the fluid ports 20 occurs. For example, in some embodiments, the burst plug assemblies 22 open at a fluid pressure of approximately 4000 psi (pounds per square inch).

In this instance, pressure in the treatment fluid can be gradually pumped up to the threshold fluid pressure level prior to the burst plug assemblies 22 being opened, so as to store considerable potential energy in the fluid. By arranging all of the burst plug assemblies 22 within one tool 10, or a series or tools, spanning one isolated zone in a fracturing string to open at substantially the same threshold fluid pressure level, the stored energy can be quickly or suddenly discharged throughout all of the isolated zone to improve frac initiation throughout the isolated zone.

The sleeve member 24 provides a tubular sleeve having a central fluid passageway 25 and is slidably mounted within the central bore 18 of the tubular housing 12 such that the central fluid passageway 25 of the sleeve 24 is orientated in the same manner as the central bore 18 of the tubular housing 12, and such that the tubular housing 12 and the sleeve 24 share a common longitudinal axis.

For multi-frac operations, the sleeve 24 is includes a deformable seat 26 and an interconnected upper collar 28. In one embodiment, the upper collar 28 and the seat 26 attach by means of complimentary, engaging threads. The sleeve 24 slides along the longitudinal axis of the tubular housing 12 in a direction towards the second end 16 of the tubular housing 12.

The sleeve 24 is moveable between a first position shown in FIG. 5 whereby the collar 28 is positioned such that it covers the fluid ports 20 blocking the flow of fluid from the central bore 18 to the fluid ports 20, and a second position shown in FIG. 6 whereby the collar 28 no longer covers the fluid ports 20 and the fluid ports 20 are exposed to fluid in the central bore 18.

In some embodiments, shear pins 30 are utilized to releasably hold the sleeve 24 in its first position pending actuation as will be described below. One skilled in the art will understand that other suitable means as commonly employed in the industry may also be used to releasably hold the sleeve 24 pending actuation.

The seat 26 is shaped to form a constriction 32 in the central passage 25. A plurality of dogs 34 are mounted within machined bores formed in the constriction 32 and orientated in a direction that is substantially perpendicular to the longitudinal axis of the central bore 18 and central passageway 25. As shown in the cross sectional end view shown in FIG. 2, the dogs 34 extend into the central passageway 25.

The actuating member 36 in this instance comprises a ball. When an appropriately sized ball 36 is discharged into the fracturing string with treatment fluid, it moves down the string until it becomes lodged on the dogs 34 of the seat 26 as shown in FIG. 3. The ball 36 blocks the constriction 32 in the central passageway 25 and reduces the flow of fluid through the central fluid passageway 25. The pressurized treatment fluid exerts a hydraulic force on the ball 36 and seat 26, breaking the shear pins 30 and causing the slidable seat 26 and attached collar 28 to move towards the second end 16 of the tubular housing 12. It is not necessary that the ball 36 and the seat 26 create a perfect seal against the flow of fluid. Rather, the ball 36 and the seat 26 need only reduce the flow of fluid to create a sufficient pressure differential upstream and downstream of the ball 36 so that the resultant force is sufficient to actuate sleeve 24 and, as discussed below, drive the ball through the sleeve 26.

The tubular housing 12 is machined such that there is a recess 38 in the inner wall of the tubular housing 12 that allows the expansion of the dogs 34. As the sleeve 24 slides towards the second end 18 of the tubular housing 12 the dogs 34 meet and expand into the recess 38 as shown in FIG. 4. As the dogs 34 expand outwardly into the recess 38, they retract slightly from the central passageway 25. This retraction allows the ball 36 to pass, as shown in FIGS. 4 and 6. At the same time as the dogs 34 expand into the recess 38, a machined groove 40 in the seat 26 mates with a projection 42 on the inner surface 13 of the tubular housing 12, to lock the sleeve 24 into its second actuated position.

As can be seen in FIG. 6, at this point, the collar 28 no longer covers the fluid port 20, so that the fluid port 20 and the burst plug assembly 22 are exposed to treatment fluid within the central bore 18. Although the embodiment described above uses dogs 34 to form the deformable seat, such suggestion is not intended to be limiting and one skilled in the art will appreciate that other ball and seat mechanisms commonly employed in the industry may be used instead.

In this manner, one actuating member 36 can be used to actuate a series of tools 10 having the same sized seat 26. The tools 10 may be placed in series in the string and are isolated by conventional isolating means, such as packers or cement, to define the isolated zone to be stimulated. The last, or lowermost, fracturing tool in the zone has a seat within a sliding sleeve sized such that, even after actuation into its second position, the ball 36 is not able to pass through the seat 26, but instead seals on the seat 26. This prevents the flow of fluid to lower zones. It can be understood that by using balls of increasing diameter, and starting with a ball having the smallest diameter, a series of isolated zones, starting with the one furthest from the well head, may be sequentially activated. For example, two to ten tools may be placed in each isolated zone. Thus, a fracturing string having ten packer isolated zones, with each zone containing ten tools, will allow an operator to stimulate one hundred stages, with just ten surface treatments.

As can be seen in the Figures, a series of seals 44 are positioned throughout the tool 10 so as to be operatively supported between the sleeve member 24 and the tubular housing 12, and straddling the flow ports 20, such that the sleeves 24 prevent the leak of treatment fluid from the tubular housing to the fluid ports 20 in the first position of the sleeve member 24 which would impair the ability maintain elevated hydraulic pressures.

Operation of the tool 10 in a method of fracturing will now be described. A tubing string with one or more of the present tools 10 is lowered into the wellbore. Conventional isolation means, such as packers mounted on the string or a cement lining, are used to create isolated treatment zones.

Each isolated treatment zone may contain one or more of the present tools 10. According to the embodiment of FIGS. 1 through 6, a ball 36 is placed into the treatment fluid and is introduced to the string. The ball passes through the string until it becomes lodged on the seat 26 of a tool in the target isolated zone. The operator increases the pressure of the treatment fluid. In one embodiment, the pressure is increased to approximately 2000 psi. The ball 36 is pressed against the dogs 34 urging the sleeve 24 into its second position, and displacing the dogs 34 radially outward into the recesses 38 so that the ball 36 may pass through the sleeve 24. The fluid ports 20 on the actuated tool 10 are now exposed to the treatment fluid passing down the string and through the central bore 18, but the burst plug assembly 22 prevents fluid communication with the wellbore. The same process is repeated for each respective tool 10 located in the selected zone until the ball 36 reaches the final tool 10 which is sized to prevent its passage even after the sleeve 24 is moved into its second position. At this point, the fluid ports 20 of all of the actuated tools 10 are uncovered, but not yet open. The operator then pressurizes the treatment fluid to the level needed to hydraulically fracture the well bore. Upon reaching the threshold pressure, in one embodiment 4000 psi, the burst plugs 22 all open at generally the same time and the opened fluid ports 20 allow fluid communication with the wellbore. There is no compromise in the pressure of the treatment fluid and all of the stages within the isolated zone are exposed to treatment fluid at the desired high pressure levels.

The use of fluid ports 20 covered by a collar 28 and each having a burst plug assembly 22, is simple, effective and relatively economic. The burst plugs 22 prevent fluid communication with the well bore until the treatment fluid has been pressured to the levels needed to hydraulically fracture the wellbore. Furthermore, the burst plugs 22 facilitate simultaneous fluid communication with the wellbore through all opened fluid ports in the isolated zone.

The tool 10 of FIGS. 1-6 can also be milled out increase production. The ball 36 flows back up the fracturing string during the recovery phase of the fracturing operation.

Turning now to the second embodiment of FIGS. 7 through 10, a further example of a pressure actuated fracturing tool 10 will now be described in further detail. The second embodiment differs from the first embodiment primarily with regard to the configuration of the deformable seat 26 and the configuration of the actuating member 36 arranged to be seated on the deformable seat 26 as described below.

In the second embodiment, the configuration of the tubular housing 12 is substantially identical in that there is provided a central bore 18 defined by the inner surface 13 extending longitudinally between the opposing first end 14 and second end 16 arranged for connection in series with the fracturing string. The fluid ports 20 are similarly circumferentially spaced about the tubular housing 12 so as to extend radially from the inner surface 13 to the outer surface 15 for fluid communication between the central bore 18 and the wellbore. A burst plug assembly 22 is disposed in each fluid port 20 to prevent the treatment fluid flowing through the fluid port 20 until the burst plug assembly is opened by exposure to the prescribed threshold hydraulic pressure level of the treatment fluid.

The sleeve member 24 of the second embodiment is also similarly supported within the central bore 18 of the tubular housing 12 so as to be longitudinally slidable relative to the tubular housing 12 between the first position in which the fluid ports 20 are covered by the sleeve member 24 and the second position in which the fluid ports 20 are substantially unobstructed by the sleeve member 24.

As in the previous embodiment, the tubular housing 12 includes a central portion of increased internal diameter which receives the sleeve member 24 therein. The sleeve member 24 is again formed of an upper collar 28 and a lower collar threadably connected to the upper collar 28 to define the deformable seat 26. The upper collar 28 and the lower collar are arranged so that they have a common outer diameter received within the central portion of the tubular housing 12 so as to be longitudinally slidable therein. An inner diameter of both the upper and lower collars forming the sleeve member 24 in this embodiment is constant across the full length of the sleeve member 24 in the longitudinal direction of the string in which the inner diameter is substantially identical to the inner diameter of the inner surface 13 of the tubular housing 12 at end portions at both axially opposed ends of the central portion receiving the sleeve member 24 therein.

The constant inner diameter of the sleeve member 24 defines the central passageway 25 extending longitudinally through the sleeve member between the axially opposing ends thereof. The deformable seat 26 disposed within the central passageway 25 again comprises dogs 34 which extend inwardly into the central passageway 25 in a first condition such that the resulting inner diameter of the central passageway 25 at the dogs 34 is reduced. As in the previous embodiment, when the sleeve member 24 is displaced to the second position, the dogs 34 align with the recess 38 to allow the dogs to be expanded outwardly from the first condition to the second condition. In the second condition, the inner diameter at the dogs 34 is the same as the remainder of the sleeve member 24 and the tubular housing 12 at opposing ends of the central portion receiving the sleeve member 24 therein.

A similar configuration of projections 42 received in a machined groove 40 retains each sleeve member 24 in the second position once displaced from the first position.

Though different in configuration than the previous embodiment, a single actuating member 36 is again associated with a series of fracturing tools associated with a single isolated zone of a fracturing string spanning multiple zones.

The actuating member 36 in this instance comprises both a generally cylindrical shuttle member 100 and a ball 102 which cooperates with the shuttle member 100 as described in the following. The shuttle member 100 has an outer diameter which is substantially equal to a prescribed inner diameter of the central passageway 25 of the sleeve member 24 and the end portions of the central bore 18 through the tubular housing 12 so as to be suited for longitudinally sliding of the shuttle member 100 through a series of tools in the fracturing string associated with a respective zone. The shuttle member 100 is thus arranged to be seated on the deformable seat 26 of each tool of the respective isolated zone in the first condition of the seat 26, but the deformable seat 26 is adapted in the second condition to allow the actuating member 100, 102 to pass through the central passageway 25 and through the tool for actuating a subsequent tool therebelow.

The shuttle member 100 comprises a sleeve having a central passage 104 extending longitudinally therethrough between opposing first and second ends. The central passage 104 has a constriction 106 wherein the internal diameter is reduced to define a ball seat 108 disposed in the central passage of the actuating member. The ball seat 108 is arranged to receive the ball 102 and form a seal against flow of treatment fluid when a ball is seated on the ball seat.

In a typical multi-frac operation, a plurality of the fracturing tools of similar configuration are connected in series with one another in a fracturing string spanning a plurality of isolated zones having multiple stages associated with each zone such that each fracturing tool is associated with a respective stage of a respective isolated zone. Each isolated zone includes a respective shuttle member 100 and cooperating ball 102 associated therewith so that the resulting actuating member comprised of the shuttle member 100 and ball 102 seated thereon is arranged to sequentially actuate all of the fracturing tools within the respective isolated zone. A lowermost one of the fracturing tools within each isolated zone is arranged to prevent displacement of the actuating member through the fracturing string beyond a bottom end of the respective isolated zone.

The ball of each isolated zone is arranged to pass through the shuttle member of each fracturing tool associated with one of the isolated zones above the respective isolated zone without actuating the shuttle member and without displacing the sleeve members of the respective fracturing tools into the second position. Within the respective zone however, the shuttle member 100 is arranged to be seated on the deformable seat 26 of each fracturing tool 10 in the first condition of the seat.

When there is provided a lower isolated zone and an upper isolated zone, each comprised of multiple stages for example, the ball of the lower isolated zone has a prescribed diameter which is arranged to be seated on the ball seat of the shuttle member of the lower isolated zone. The constriction 106 in the shuttle member 100 of the upper zone has a greater inner diameter than the constriction 106 of the lower zone such that the diameter of the lower ball 102 is arranged to pass through the ball seat of the shuttle member of the upper isolated zone without being seated thereon and without displacing the shuttle member of the upper isolated zone to be seated on the various deformable seats 26 of the tools of the upper zone. The ball of the upper isolated zone however has a prescribed diameter which is greater than the ball of the lower zone so as to be arranged to be seated on the ball seat 108 of the shuttle member of the upper isolated zone.

The use of the fracturing tools 10 according to the second embodiment involves providing a fracturing tool 10 associated with each stage of a plurality of zones comprising multiple stages per zone. Each zone includes a single actuating member associated with all tools in that zone. The shuttle member 100 is initially positioned within the fracturing string above the uppermost tool of the respective zone and all sleeve members are initially in the first position.

A lowermost zone is initially isolated by directing the ball associated with that zone downwardly through the fracturing string to be seated within the respective shuttle member by pumping the treatment fluid downwardly through the fracturing string. Once the ball is seated on the shuttle member, continued pumping of treatment fluid directs the shuttle member downwardly to be sequentially seated on the deformable seats of the associated tools to sequentially displace the sleeve member of each fracturing tool associated with the lower isolated zone into the second position. Once the shuttle member and associated ball are located within a lowermost one of the fracturing tools associated with the lower isolated zone, further downward movement is prevented so as to form a seal against a flow of the treatment fluid. Continued pumping of the treatment fluid to achieve the threshold hydraulic pressure level then opens the burst plugs in the fluid ports of the lower isolated zone to hydraulically fracture the well bore within the lower isolated zone.

The upper zone is subsequently isolated for fracturing by directing the ball of the upper isolated zone downwardly through the fracturing string such that the ball is seated on the shuttle member of the upper isolated zone and the sleeve members in the upper isolated zone are sequentially displaced into the second position. Once the ball and shuttle member of the upper isolated zone are located within a lowermost one of the fracturing tools associated with the upper isolated zone, the ball and actuating member are prevented from further downward displacement so as to form a seal against a flow of the treatment fluid. Continued pumping of the treatment fluid to achieve the threshold hydraulic pressure level then opens the burst plug assemblies in the fluid ports and hydraulically fractures the well bore within the upper isolated zone.

As in the previous embodiment, by uncovering all burst plug assemblies in an isolated zone prior to opening the burst plugs, pressure in the treatment fluid can be gradually pumped up to the threshold fluid pressure so as to store considerable potential energy in the fluid. By further arranging all of the burst plug assemblies within one tool or a series or tools spanning one isolated zone in a fracturing string to open at substantially the same threshold fluid pressure level, the stored energy can be quickly or suddenly discharged throughout all of the isolated zone to improve frac initiation throughout the isolated zone.

Figure 11:
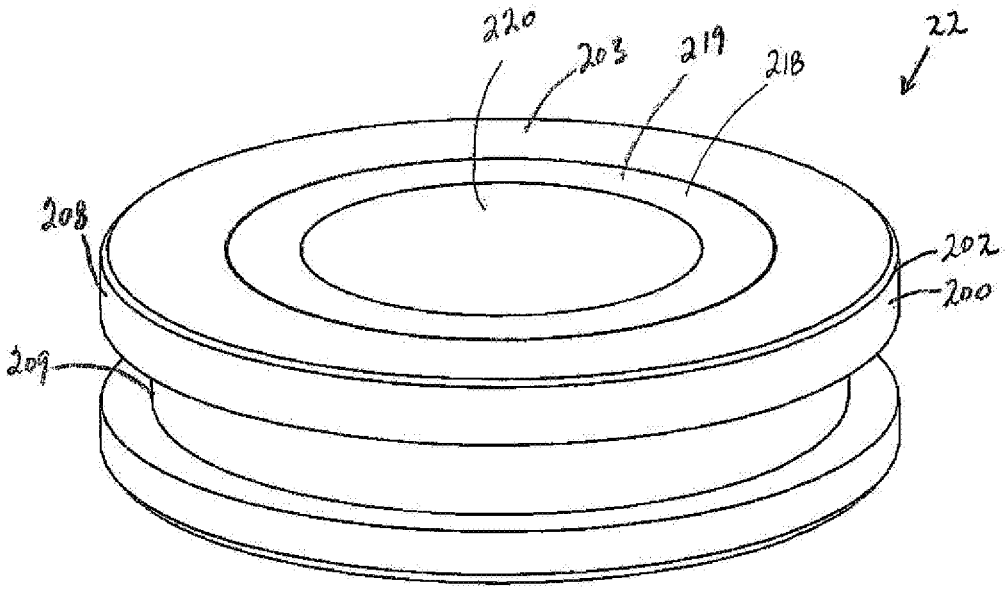
FIG. 11 is a side perspective view of one embodiment of the burst plug assembly for use in the tools of FIGS. 1-10, showing a choke insert retained within the body of the burst plug assembly.
Figure 12:
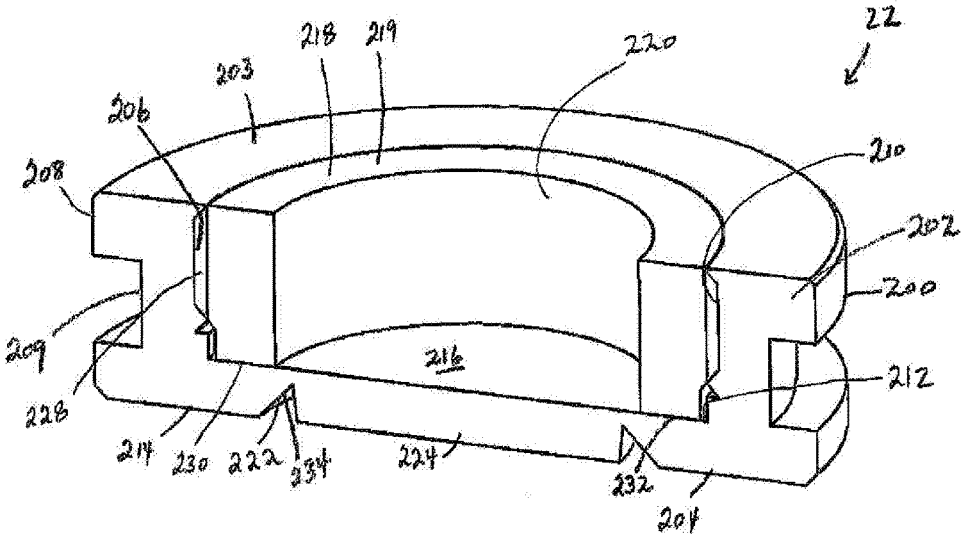
FIG. 12 is a perspective view of a section of the burst plug assembly of FIG. 11, showing a circular core circumscribed by a groove and still intact in the bottom wall.
Figure 13:
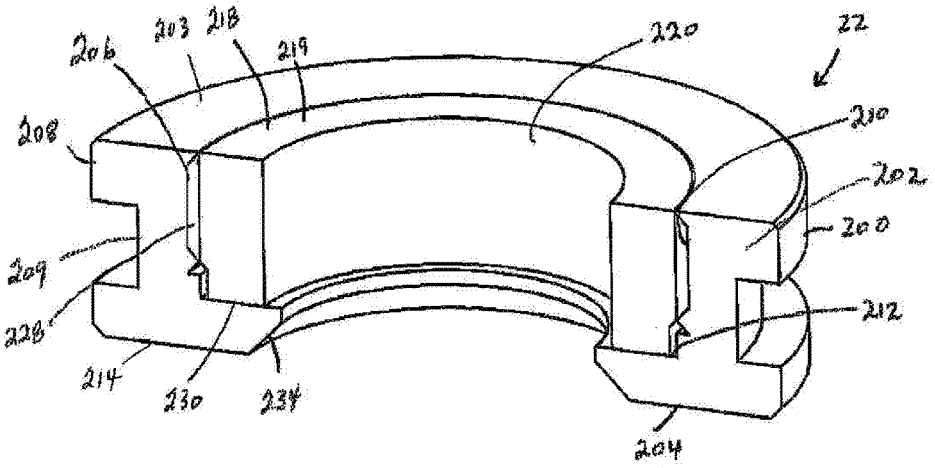
FIG. 13 is a perspective view of the section of FIG. 12, but after the circular core has disengaged from the bottom wall.

One embodiment of the burst plug assembly 22 adapted to be retained in each fluid port 20 of the fracturing tools of FIGS. 1-10, is shown in greater detail in FIGS. 11-13. The burst plug assembly 22 includes a body 200 having an annular side wall 202 and a closing wall 204. The side wall 202 and closing wall 204 are preferably formed integrally in a single piece, from a metal material such as bronze, brass and aluminum, such that at least the closing wall 204 has consistent properties for bursting under pressure. The closing wall 204 is generally perpendicular to the side wall 202. The side wall 202 has an inner surface 206 and an outer surface 208. In the Figures, the outer surface 208 is adapted to retain and seal the body 200 in the fluid port 20 of the fracturing tool 10, with a circumferential groove 209 that holds a seal, such as an O-ring, for sealing to the fluid port. The side wall 202 may be retained in the fluid port 20 by alternate retaining means, such as a retaining ring (ex. snap ring), or with threads. The inner surface 206 of the side wall 202 forms a central bore 210, which in one embodiment is adapted to be outwardly opening, and wellbore facing, when the burst plug assembly 22 is retained in the fluid port 20. An optional debris cover may be retained in the fluid port between the burst plug assembly and the wellbore to prevent cement or other debris from entering the central bore 210, for example during cementing operations.

In FIGS. 11-13, the closing wall 204 is shown as a bottom wall, such that the central bore 210 is closed at an inward end portion 212 of the side wall 202 by the bottom wall 204. The bottom wall 204 is a solid wall, formed without apertures or perforations so as to prevent fluid flow through the fluid port 20 in the closed condition. The bottom wall 204 has opposed inner and outer faces 214, 216 which are preferably planar and generally parallel one with another. In some embodiments, when retained in the fluid port 20, the outer face 216 is wellbore-facing when located in a wellbore, while the inner face 214 faces the central bore of the fracturing tool. The outer face 216 generally faces the central bore 210 of the body 200. In some embodiments, the burst plug assembly 22 may be oriented in a reverse or flipped manner in the fluid port 20, such that the outer face 216 faces the central bore of the fracturing tool and the inner face 214 faces the wellbore.

A choke insert 218 is retained in the central bore 210 of the body 200 and lines the inner surface 206 of the annular side wall 202 along the central bore 210. Preferably, the choke insert 218 extends along the entire inner surface 206 of the annular side wall 202, as shown in FIGS. 12 and 13, with the top wall portion 219 of the choke insert 218 flush with the top wall portion 203 of the body 200. The choke insert 218 is seated within the central bore 210, preferably against the bottom wall 204. The choke insert 218 forms an inner bore 220 extending through the choke insert 218. The choke insert 218 is formed of a wear resistant material such as tungsten carbide, a wear resistant ceramic material, and a hardened, high strength steel or metal alloy. Hardened, carbide steel is an exemplary material.

Figure 2:
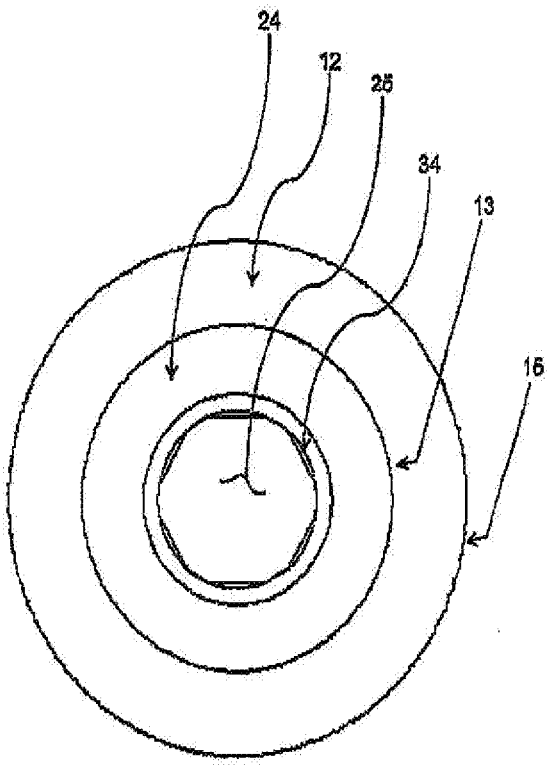
FIG. 2 is a cross sectional end view of the fracturing tool of FIG. 1.

A groove 222, preferably continuous, is formed in one or both of the inner and outer faces 214, 216 of the bottom wall 204 and circumscribes the periphery of a core 224 in the bottom wall 204. In FIG. 2, the core 224 is shown as circular, and the groove is formed in the inner face 214 of the bottom wall 204. The groove 222 is sized and located so that the largest dimension of the core 224 is no greater than the diameter of the inner bore 220, such that when a prescribed threshold hydraulic pressure level of the treatment fluid is applied to the inner face 214 of the bottom wall 204 the core 224 disengages from the bottom wall 204 along the groove 222 in a bursting action and passes through the inner bore 220 of the choke insert 218, so that the treatment fluid can be pumped under pressure through the inner bore 220 with limited erosion of the inner bore 220 of the choke insert 218, and thus of the burst plug assembly 22 itself. A circular core 224 is preferred, with the groove 22 and the core 224 having a diameter no greater than that of the inner bore 220. This ensures that the core 224 readily passes through the inner bore 220 once it disengages from the bottom wall 204.

In preferred embodiments, the diameter of the groove 222 and of the inner bore 220 are sized such that the inner bore 220 is fully open immediately after the core 224 disengages and passes through the inner bore 220, so that continued pumping of the treatment fluid through the inner bore 220 maintains a prescribed flow rate of the treatment fluid sufficient for fracturing a wellbore adjacent the burst plug assembly without significant variation due to erosion of the inner bore 220 of the choke insert 218. In such embodiments, the prescribed flow rate may be calculated and set by the operator based on the fixed size of the orifice through each and all of the burst plug assemblies being the full diameter of the inner bore of the choke insert in each and all of the burst plug assemblies 22.

In some embodiments, the inner surface 206 of the annular side wall 202 and an outer surface 226 of the choke insert 218 are formed with engaging threads 228 to retain the choke insert 218 in the central bore 210 of the body 200, and to provide a metal to metal seal between the body 200 and the choke insert 218. In some embodiments, the choke insert 218 may be retained in the central bore 210 by alternate retaining means such as a snap ring or a threaded retaining ring. Retaining with the engaging threads 228 is preferred in order to provide the metal to metal seal and to avoid the need for elastomeric seals such as O-rings within the central bore 210. The erosive and/or corrosive nature of the treatment fluid can damage elastomeric seals. Furthermore, using the threads 228 to retain the choke insert 218 has the advantage of securely seating the choke insert 218 directly against the bottom wall 204 in a manner which resists inward and/or outward movement of the choke insert 218. In this manner, when treatment fluid is pumped up to the prescribed threshold hydraulic pressure level sufficient to disengage the core 224 from the bottom wall 204, the portion of the choke insert 218 which is securely seated directly against the bottom wall 204, namely lower wall portion 230 of the choke insert 218, is held securely by the threads 228, so that the choke insert 218 resists ballooning of the bottom wall 204 under pressure. Thus, the choke insert 218 assists in ensuring that the core 224 bursts and disengages in a single core piece, and with greater precision and reliability, along the groove 222.

In some embodiments, the portion of the bottom wall 204 extending between the annular side wall 202 and the groove 222 forms an annular seat 232 for the choke insert 218. After the circular core 224 disengages from the bottom wall 204, as shown in FIG. 13, the annular seat 232 provides an annular lip 234, to direct the treatment fluid into the inner bore 220 while preventing the treatment fluid from penetrating the engaging threads 228 between the choke insert 218 and the body 200. When the groove 222 is generally V-shaped in cross section, as shown in FIG. 12, the annular lip 234 formed after the core 224 is ejected is generally inwardly tapered to assist in directing the treatment fluid into the inner bore 220.

When the burst plug assembly 22 is used in fracturing operations, once the core 224 disengages from the bottom wall 204, by achieving the prescribed threshold hydraulic pressure level of the treatment fluid, the operator may continue pumping the treatment fluid under pressure through the inner bore 220 of the burst plug assembly 22 at a prescribed flow rate sufficient for hydraulically fracturing the isolated zone adjacent the burst plug assembly without significant variation due to erosion of the inner bore 220, and thus of the burst plug assembly 22. The choke insert 218 of the burst plug assembly 22 of this invention, provides a reliable and predictable flow restriction, i.e., a fixed choking restriction, at each fluid ports for the continued pumping of treatment fluid through the inner bore 220 of choke insert 218. Particularly for multi-frac operations, erosion at the flow ports is minimized with burst plug according to this invention, so that the flow port restriction is not enlarged and/or washed out at the high fracturing pressures. This results in more predictable and reliable flow rates at each and every burst plug assembly, without significant variation in the orifice size due to erosion of the inner bore 220 at any one or more of the burst plug assemblies.

In fracturing operations, a reliable opening of the flow ports in the fracturing tools is important. The fracturing operators prefer a reliable and predictable flow restriction (i.e., flow area and orifice diameter) at the flow ports when pumping fluid downhole. Prior to this invention, erosion of the fluid ports, whether or not closed with burst plugs, has remained problematic in fracturing operations, particularly in view of the erosive and/or corrosive nature of the treatment fluids used for fracturing. In prior art multi-frac operations, erosion at the flow ports of the fracturing tools has enlarged and/or washed out one or more of the flow ports. This resulted in unpredictable, unreliable and uneven injection into the wellbore at each of the multi-frac sites. The burst plug assembly of this invention, with choke inserts, addresses the issues of erosion and in a manner that allows the operator to maintain prescribed flow rates sufficient for fracturing at each of the burst plug assemblies without variation due to erosion of the inner bore of the choke insert. By limiting erosion of the inner bore of the choke inserts, a fixed diameter orifice is maintained at each burst plug assembly for the duration of the fracturing operation.

The inclusion of the choke inserts in the burst plug assemblies of this invention thus avoids issues of some prior art fracturing tools, where low pumping rates were needed to slowly erode or corrode fluid port covers. As noted above, low pumping rates can cause sanding off at one or more of the fluid ports. As well, the choke inserts and the burst plug assemblies of this invention address prior art issues of total or selective erosion at one or more of the fluid ports. In the present invention, by preventing or minimizing erosion of the inner bore of the choke inserts in each burst plug assembly, the prescribed flow rate sufficient for fracturing can be achieved instantly upon bursting of the burst plug assemblies, and this prescribed flow rate, without significant pressure drop, can be maintained by the operator with confidence that treatment fluid continues to flow through each of the burst plug assemblies, without selective erosion at one or more of the burst plug assemblies interfering with, and causing, variation in the prescribed flow rate due to erosion at eroded burst plugs.

Terms relating to position or orientation, such as "upper", "lower", "top", "bottom", "inner", "outer", "inward" and "outward" are used for convenience of description and relative positioning for features as shown in the figures but, unless otherwise stated, such terms are not intended to limit the features of the invention to a particular position or orientation.

As used herein and in the claims, the term "treatment fluid" includes any pumpable liquid fluid delivered to an isolated zone of a wellbore to stimulate production including, but not limited to, fracturing fluid, acid, gel, foam or other stimulating fluid, and which may carry solids including, but not limited to, sand.

As used herein and in the claims, the terms "tubing string" and "fracturing string" may be used interchangeably, and may refer to a "casing", a "tubing", a "liner" or other connected tubular members, as is generally understood in fracturing operations.

As used herein and in the claims, the word "comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless the context clearly requires that there be one and only one of the elements.

All references mentioned in this specification are indicative of the level of skill in the art of this invention. All references are herein incorporated by reference in their entirety to the same extent as if each reference was specifically and individually indicated to be incorporated by reference. However, if any inconsistency arises between a cited reference and the present disclosure, the present disclosure takes precedence. Some references provided herein are incorporated by reference herein to provide details concerning the state of the art prior to the filing of this application, other references may be cited to provide additional or alternative device elements, additional or alternative materials, additional or alternative methods of analysis or application of the invention.

The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow. Although the description herein contains many specifics, these should not be construed as limiting the scope of the invention, but as merely providing illustrations of some of the embodiments of the invention.

One of ordinary skill in the art will appreciate that elements and materials other than those specifically exemplified can be employed in the practice of the invention without resort to undue experimentation. All art-known functional equivalents, of any such elements and materials are intended to be included in this invention. The invention illustratively described herein suitably may be practised in the absence of any element or elements, limitation or limitations which is not specifically disclosed herein.

We claim:

1. A burst plug assembly for use in a fluid port formed in a side wall of a tubular fracturing tool, the fluid port extending from an inner surface of a central bore of the fracturing tool to an outer surface of the fracturing tool, the burst plug assembly comprising:

a body having an annular side wall and a closing wall, the side wall having an inner surface and an outer surface, the outer surface being adapted to retain and seal the body in the fluid port of the fracturing tool, the inner surface forming an outwardly opened central bore which is closed by the closing wall, the closing wall having opposed inner and outer faces, with the outer face facing the central bore of the body;

a choke insert retained in the central bore of the body and lining the inner surface of the annular side wall along the central bore, the choke insert forming an inner bore extending through the choke insert, and the choke insert being formed of a wear resistant material;

a groove formed in one or both of the inner and outer faces of the closing wall and circumscribing a core in the closing wall, the groove being sized and located so that a largest dimension of the core is no greater than a diameter of the inner bore, such that when a prescribed threshold hydraulic pressure level of a treatment fluid is applied to the closing wall the core disengages from the bottom wall along the groove in a bursting action and passes through the inner bore of the choke insert, so that the treatment fluid can be pumped under pressure through the inner bore of the inner bore of the choke insert;

wherein the core is circular and wherein a diameter of the groove and the diameter of the inner bore are sized such that the inner bore is fully open after the core disengages; and wherein the inner surface of the annular side wall and an outer surface of the choke insert are formed with engaging threads to retain the choke insert in the central bore and to provide a metal to metal seal between the body and the choke insert.

2. The burst plug assembly of claim 1, wherein the closing wall is a bottom wall formed integrally with the side wall at an inward end portion of the side wall, and wherein the choke insert is seated on the bottom wall.

3. The burst plug assembly of claim 2, wherein the groove is formed in the inner face of the bottom wall, and wherein a portion of the bottom wall extending between the annular side wall and the groove forms a seat for the choke insert, and which, after the circular core disengages, forms a lip to direct the treatment fluid into the inner bore while preventing the treatment fluid from penetrating the engaging threads between the choke insert and the body.

4. The burst plug assembly of claim 3, wherein the choke insert extends along the entire inner surface of the annular side wall.

5. The burst plug assembly of claim 4, wherein the inner and outer faces of the bottom wall are planar, and the groove is generally V-shaped in cross section.

6. The burst plug assembly of claim 5, wherein the outer surface of the annular side wall is formed with a circumferential groove to hold a seal for sealing to the fluid port.

7. The burst plug assembly of claim 6, wherein the choke insert is formed from a material selected from tungsten carbide, a wear resistant ceramic material, and a hardened, high strength steel or metal alloy.

8. The burst plug assembly of claim 6, wherein the choke insert is formed from a hardened carbide steel.

9. The burst plug assembly of claim 7, wherein the body is formed from a metal selected from bronze, brass and aluminum.

10. The burst plug assembly of claim 7, wherein the body is formed from brass.

11. A fracturing tool for use in a fracturing string for hydraulically fracturing a wellbore with treatment fluid using a prescribed threshold hydraulic pressure level, the fracturing tool comprising:

a tubular housing extending longitudinally between opposing first and second ends arranged for connection in series with the fracturing string, the tubular housing having an inner surface defining a central bore extending through the tubular housing from the first end to the second end, and a fluid port extending from the inner surface to an outer surface of the tubular housing for fluid communication between the central bore and the wellbore;

a burst plug assembly as defined in claim 1 retained and sealed in the fluid port, the burst plug assembly being operable from a closed condition, in which the burst plug assembly maintains a fluid seal to prevent the treatment fluid flowing through the fluid port below the prescribed threshold hydraulic pressure level, to an open condition, in which the core passes through the inner bore and the burst plug assembly is opened in response to the prescribed threshold hydraulic pressure level of the treatment fluid to allow the treatment fluid to flow through the inner bore of the burst plug assembly; and a closure member supported within the central bore of the tubular housing operable between a first position in which the burst plug assembly is covered by the closure member and a second position in which the burst plug assembly is substantially unobstructed by the closure member.

12. The fracturing tool of claim 11, wherein the fluid port is one of a plurality of fluid ports circumferentially spaced about the tubular housing and oriented substantially perpendicularly to a longitudinal axis of the tubular housing, and wherein the burst plug assembly is retained and sealed in each of the plurality of fluid ports.

13. The fracturing tool of claim 12, wherein the closure member is a sliding sleeve having a seat formed therein and operable to shift from the first position to the second position when the actuating member is seated and sealed on the seat.

14. The fracturing tool of claim 12, wherein the closure member comprises:

a sleeve member supported within the central bore of the tubular housing so as to be longitudinally slidable relative to the tubular housing between the first position in which the burst plug assembly is covered by the sleeve member and the second position in which the burst plug assembly is substantially unobstructed by the sleeve member, the sleeve member comprising:

a central passageway extending longitudinally therethrough; and a deformable seat disposed in the central passageway so as to be operable between a first condition in which the deformable seat is adapted to receive the actuating member seated thereon and a second condition in which the deformable seat is adapted to allow the actuating member to pass through the central passageway, the deformable seat being operable from the first condition to the second condition only upon displacement of the sleeve member into the second position; and seals operatively supported between the sleeve member and the tubular housing to prevent leaking of the treatment fluid from the tubular housing to the at least one fluid port in the first position of the sleeve member.

15. The fracturing tool of 14, in combination with a plurality of the actuating members, the fracturing tool being one of a plurality of the fracturing tools connected in series with one another in a fracturing string spanning a plurality of isolated zones and having multiple stages associated with each of the plurality of isolated zones, such that each of the plurality of fracturing tools is associated with a respective stage of a respective isolated zone, each of the plurality of actuating members is associated with one of the respective isolated zones to sequentially actuate each of the plurality of the fracturing tools within the respective isolated zone, and the burst plug assembly of the fluid port in each of the plurality of fracturing tools associated with the respective isolated zone is operable from the closed position to the open condition in response to the prescribed threshold hydraulic pressure level of the treatment fluid.

16. The fracturing tool of claim 15, wherein a lowermost one of the plurality of fracturing tools within each of the plurality of isolated zones is arranged to prevent displacement of the actuating member through the fracturing string beyond a bottom end of the respective isolated zone, the closure member of the lowermost one of the plurality of fracturing tools comprising a sliding sleeve having a seat formed therein and operable to shift from the first position to the second position when the actuating member is seated and sealed on the seat.

17. A method of hydraulically fracturing an isolated zone in a wellbore using a treatment fluid which can achieve a prescribed threshold hydraulic pressure level, the method comprising the steps of:

i) providing a fracturing tool in a fracturing string spanning the isolated zone of the wellbore, the fracturing tool comprising:

a tubular housing having an inner surface defining a central bore and a fluid port extending through a side wall of the tubular housing, a burst plug assembly as defined in claim 1 retained and sealed in the fluid port, the burst plug assembly being operable from a closed condition, in which the burst plug assembly maintains a fluid seal to prevent the treatment fluid flowing through the fluid port below the prescribed threshold hydraulic pressure level, to an open condition, in which the burst plug assembly is opened in response to the prescribed threshold hydraulic pressure level of the treatment fluid; and a closure member supported within the central bore of the tubular housing operable between a first position in which the burst plug assembly is covered by the closure member and a second position in which the burst plug assembly is substantially unobstructed by the closure member;

ii) locating the fracturing tool in a fracturing string spanning the isolated zone of the wellbore with the closure member in the first position;

iii) moving the closure member to the second position;

iv) pumping the treatment fluid to achieve the prescribed threshold hydraulic pressure level to open the burst plug assembly in the fluid port; and v) continuing pumping the treatment fluid under pressure through the inner bore of the burst plug assembly at a prescribed flow rate sufficient for hydraulically fracturing the isolated zone adjacent the burst plug assembly.

18. The method of claim 17, wherein:

the closure member comprises a sleeve member sealed within the central bore of the tubular housing so as to be longitudinally slidable relative to the tubular housing, in response to an actuating member being seated within the sleeve member, between the first position in which the burst plug assembly is covered by the sleeve member and the second position in which the burst plug assembly is substantially unobstructed by the sleeve member;

the sleeve member is moved to the second position by directing the actuating member through the tubing string to seat in the sleeve member to displace the sleeve member into the second position, and to seal against the flow of the treatment fluid past the sleeve member at an actuation hydraulic pressure level of the treatment fluid which is less than the prescribed threshold hydraulic pressure level of the treatment fluid;

the fluid port is one of a plurality of fluid ports circumferentially spaced about the tubular housing and oriented substantially perpendicularly to a longitudinal axis of the tubular housing;

and in step v), pumping of the treatment fluid under pressure is continued through the inner bore of each burst plug assembly at the prescribed flow rate.

19. The method of claim 17, adapted for hydraulically fracturing multiple stages within a lower isolated zone in the wellbore with the treatment fluid which can achieve a prescribed threshold hydraulic pressure level, the method comprising the steps of:

a) providing a plurality of the fracturing tools, each of the plurality of the fracturing tools being connected in series with one another in a fracturing string spanning the lower isolated zone such that each of the plurality of the fracturing tools is associated with a respective stage of the lower isolated zone, wherein the closure member of each of the plurality of the fracturing tools comprises:

a sleeve member supported within the central bore of the tubular housing so as to be longitudinally slidable relative to the tubular housing between the first position in which the burst plug assembly is covered by the sleeve member and the second position in which the burst plug assembly is substantially unobstructed by the sleeve member, the sleeve member comprising:

a central passageway extending longitudinally therethrough; and a deformable seat disposed in the central passageway so as to be operable between a first condition in which the deformable seat is adapted to receive the actuating member seated thereon and a second condition in which the deformable seat is adapted to allow the actuating member to pass through the central passageway, the deformable seat being operable from the first condition to the second condition only upon displacement of the sleeve member into the second position; and seals operatively supported between the sleeve member and the tubular housing to prevent leaking of the treatment fluid from the tubular housing to the at least one fluid port in the first position of the sleeve member;

b) providing a lowermost of the fracturing tools in the fracturing string below the plurality of the fracturing tools, the closure member of the lowermost fracturing tool comprising a sliding sleeve having a seat formed therein and operable to shift from the first position to the second position when the actuating member is seated and sealed on the seat;

c) providing one of the actuating members to be associated with the plurality of the fracturing tools and the lowermost fracturing tool associated with the lower isolated zone;

d) directing the actuating member associated with the lower zone downwardly through the fracturing string to sequentially displace the sleeve member of each of the plurality of the fracturing tools associated with the lower isolated zone into the second position at an actuation hydraulic pressure level of treatment fluid which is less than the prescribed threshold hydraulic pressure level of treatment fluid;

e) locating and seating the actuating member within the lowermost fracturing tool associated with the lower isolated zone so as to shift the sliding sleeve to the second position and to form a seal against a flow of the treatment fluid;

f) pumping the treatment fluid to achieve the prescribed threshold hydraulic pressure level to open the burst plug assembly in the fluid port of the plurality of the fracturing tools and the lowermost fracturing tool associated with the lower isolated zone; and g) continuing pumping the treatment fluid under pressure through the inner bore of each burst plug assembly of the plurality of the fracturing tools and of the lowermost fracturing tool associated with the lower isolated zone at a prescribed flow rate sufficient for hydraulically fracturing the lower isolated zone adjacent each of the burst plug assemblies.

20. The method of claim 19, wherein the fluid port is one of a plurality of fluid ports circumferentially spaced about the tubular housing of each of the plurality of the fracturing tools and of the lowermost fracturing tool, and oriented substantially perpendicularly to a longitudinal axis of the tubular housing.

21. The method of claim 20, further comprising hydraulically fracturing multiple stages within an upper isolated zone above the lower isolated zone by the steps of:

h) providing the plurality of the fracturing tools, each of the plurality of the fracturing tools being connected in series with one another in a fracturing string spanning the upper isolated zone such that each of the plurality of the fracturing tools is associated with a respective stage of the upper isolated zone;

i) providing the lowermost fracturing tool in the fracturing string below the plurality of fracturing tools of step h);

j) providing one of the actuating members to be associated with the plurality of the fracturing tools and the lowermost fracturing tool associated with the upper isolated zone;

k) repeating steps d) to g), but adapted to hydraulically fracture the wellbore within the upper isolated zone.

22. The method according to claim 21, wherein the upper and lower isolated zones of the wellbore include are isolated with a cement liner or a plurality of packers.

* * * * *